US007312705B2

(12) United States Patent
Garavuso et al.

(10) Patent No.: US 7,312,705 B2
(45) Date of Patent: Dec. 25, 2007

(54) SECURITY DEVICE WITH ADJUSTABLE MAGNET LOCATION

(75) Inventors: Michael Garavuso, Oceanside, NY (US); Thomas S Babich, Glen Cove, NY (US); Kevin G Piel, Ronkonkoma, NY (US)

(73) Assignee: Honeywell International, Inc., Morristown, NJ (US)

( * ) Notice: Subject to any disclaimer, the term of this patent is extended or adjusted under 35 U.S.C. 154(b) by 204 days.

(21) Appl. No.: 11/242,477

(22) Filed: Oct. 3, 2005

(65) Prior Publication Data

US 2007/0075859 A1 Apr. 5, 2007

(51) Int. Cl.
*G08B 13/08* (2006.01)

(52) U.S. Cl. ..... 340/547; 200/61.72

(58) Field of Classification Search ..... 340/547, 340/545.1, 541, 693.5, 693.9; 335/205–207; 49/13; 200/61.72
See application file for complete search history.

(56) References Cited

U.S. PATENT DOCUMENTS 4,210,888 A * 7/1980 Holce ..... 335/205
4,213,110 A * 7/1980 Holce ..... 335/205
5,007,199 A 4/1991 Dunagan et al.
5,164,705 A * 11/1992 Dunagan et al. ..... 340/547
5,554,833 A 9/1996 Johnson
5,576,678 A * 11/1996 Saunders ..... 335/205

OTHER PUBLICATIONS

VS Venting Switch Set Series, http://www.grisk.com/specialty/vent_switch. htm; Nov. 2, 2005.

* cited by examiner

*Primary Examiner*—Thomas Mullen
(74) *Attorney, Agent, or Firm*—Anthony R. Barkume, P.C.

(57) ABSTRACT

A security device that is adapted to be affixed along a window to provide anti-intruder protection while providing the ability to open the window a variable amount for venting an area. The security device comprises a magnetic member, located in a housing, and means for mounting the magnetic member at a desired location along the housing. The means for mounting the magnetic member may comprise a track extending substantially along the length of the housing and means for slidingly engaging the magnetic member along the track, whereby the magnetic member may be engaged at a desired location. The security device further comprises a contact switch adapted to provide a closed signal to a security system when the contact switch is in proximity to the magnetic member and an open signal when the contact switch is not in proximity to the magnetic member.

13 Claims, 5 Drawing Sheets

SECURITY DEVICE WITH ADJUSTABLE MAGNET LOCATION

TECHNICAL FIELD

This invention relates to security systems, and in particular to a security system device affixed to a window that is adjustable to allow adjustable venting of the window.

BACKGROUND ART

Typically, security systems provide protection against intruders at each window and door throughout a building or dwelling. One type of security device used for the protection of the windows are magnetic reed switch detectors (also known as contact switches) located on the window jambs and magnets located on the window frames. As the window is opened, the magnet is moved away from the reed switch detector causing it to transmit an "open" signal to the security system controller. If the security system is armed, then the controller will generate an alarm signal, which may be sent to a central station monitoring service and/or sound a local siren as well known in the art. If the security system is unarmed, then no alarm signal will be generated.

In order to allow an end user/homeowner to open a window partially in order to vent a room while maintaining operability of the window security device, installers may attach two magnets to the window. One magnet allows the reed switch detector to transmit a normal, or closed, signal to the system controller when the window is in a closed position. A second magnet located approximately four inches below the first magnet allows the reed switch detector to transmit the closed signal to the system controller when the window is in a vented position since that second magnet will align with the detector when the window is in a vented (i.e. partially open) position. The end user/homeowner can select only one of these two window positions prior to arming the security system. One problem is that the vented position selected by the installer may not be the preferred or ideal position sought after by the end user/homeowner.

It is therefore an object of the present invention to provide a security device that allows an end user/homeowner flexibility in selecting a preferred vented window or sliding door position.

It is a further object of the present invention to provide a security system that uses the security device to allow an end user/homeowner flexibility in selecting a preferred vented position.

Finally, it is a further object of the present invention to provide a method that allows an end user flexibility in selecting a preferred vented position.

DISCLOSURE OF THE INVENTION

The security device of the present invention is a component of a security system that is adapted to be affixed along a window to provide anti-intruder protection while providing the ability to open the window a variable amount for venting an area. The security device comprises a magnetic member located in a housing, wherein the length of the housing is substantially longer than the length of the magnetic member, and means for mounting the magnetic member at a desired location along the housing and relocating the magnetic member to a different location when desired. The means for mounting the magnetic member may comprise a track extending substantially along the length of the housing and means for slidingly engaging the magnetic member along the track, whereby the magnetic member may be engaged at a desired location. Additionally, the means for slidingly engaging the magnetic member may comprise a plurality of notches located along the length of the track and notch engagement means located on the magnetic member for allowing selective engagement of the magnetic member.

The security device further comprises a contact switch adapted to provide a first output signal, or a normal closed signal, to a security system when the contact switch is in proximity to the magnetic member and a second output or open signal to the security system, when the contact switch is not in proximity to the magnetic member.

The present invention also is a security system that includes the security device described above affixed to a window, a control panel, and means for communicating the first and second output signals from the contact switch to the control panel. The housing of the magnetic member is affixed to a first component of the window, which may be the window frame, and the contact switch is affixed to a second component of the window, which may be the window jamb. Alternatively, the housing with the magnetic member may be affixed to the window jamb while the contact switch is affixed to the window frame. The magnetic member located in the housing is in proximity to the contact switch when the first component of the window and the second component of the window are in a first relative position with respect to each other, which may be a closed position or a vented position, and to be out of proximity to the magnetic member when the first component of the window and the second component of the window are in a second relative position with respect to each other, which is a substantially open position.

The present invention is also a method of adjusting the security device described above, wherein the security device is a component of the security system. The method comprises two steps: (1) locating the magnetic member in a first position in the housing such that when the window is in a closed position, the magnetic member is in close proximity to the contact switch causing the contact switch to output a closed signal, and when the window is in a second position the magnetic member is not in close proximity to the contact switch causing the contact switch to output an open signal; and (2) relocating the magnetic member to a second position in the housing such that when the window is in a vented position the magnetic member is in close proximity to the contact switch causing the contact switch to output a closed signal, and when the window is in a second position the magnetic member is not in close proximity to the contact switch causing the contact switch to output an open signal. In the last step, relocating the magnet member requires an end user/homeowner to slide the magnetic member along a track located in the housing in a preferred embodiment.

BEST MODE FOR CARRYING OUT THE INVENTION

Figure 1:
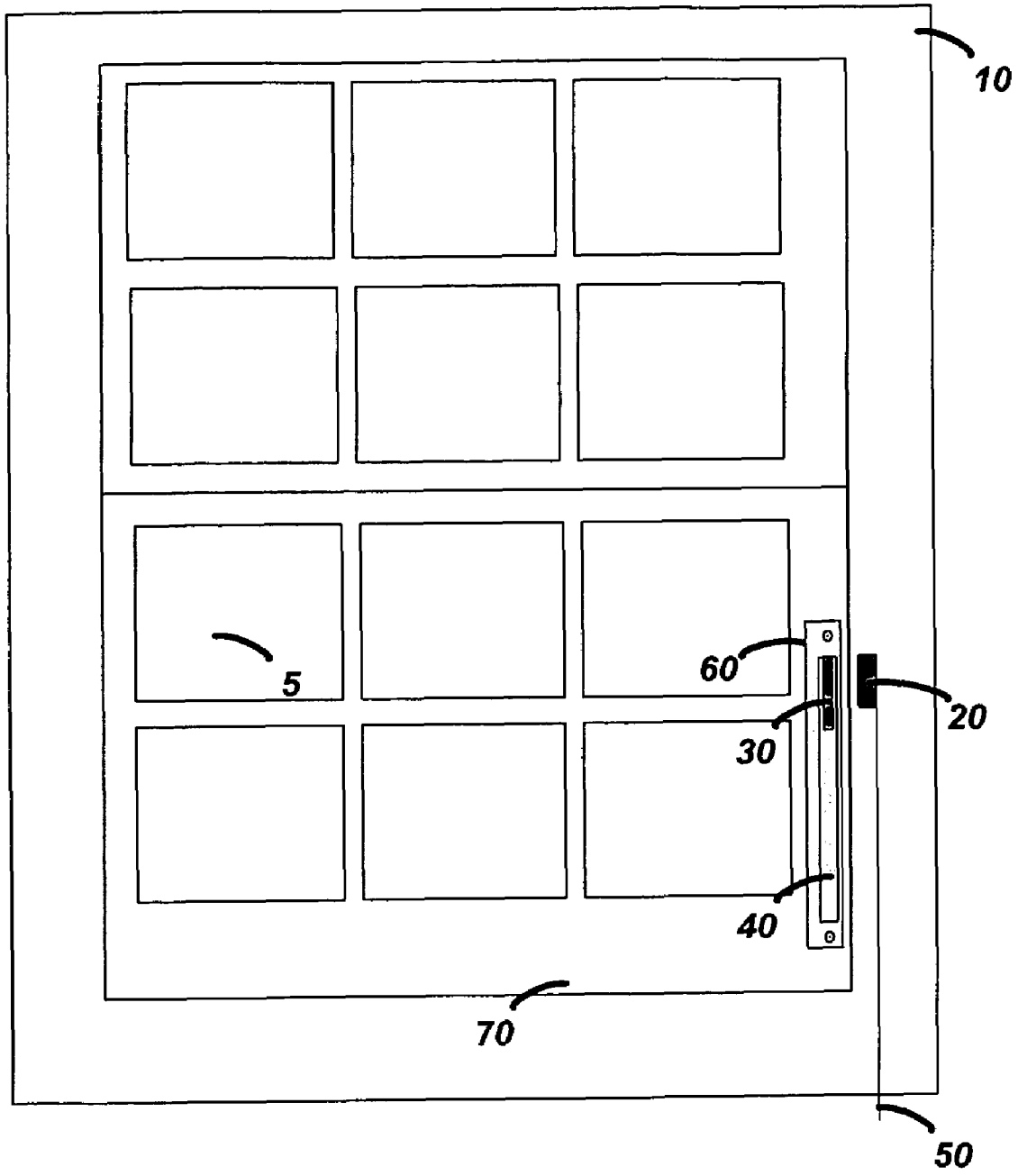
FIG. 1 is a diagram of the security device of the present invention on a closed window.

The preferred embodiments of the present invention will now be described with respect to the Figures. FIG. 1 illustrates the use of the security device of the present invention installed on a window 5, which is shown in the closed position. The window 5 includes a window jamb 10 and a window frame 70 which slides up and down between a closed position and an open position as well known in the art. A reed or contact switch 20 is located on the window jamb 10. A communication means includes a data transmitter (part of the contact switch housing as well known in the art, not shown) and a wire 50 that leads from the switch 20 to the security system (not shown). A wireless RF communication means may also be used as well known in the art. A housing 60 is mounted on the window frame 70 and contains a magnet 30, which may be for example the MPS45 from ADEMCO, and a magnet track 40. As can be seen, the magnet 30 is located at the top of the track 40 at a position that is in close proximity to the contact switch 20. This will cause the communication means to transmit a closed signal. When the window 5 is opened, the magnet 30 will move away from the contact switch 20 and therefore not be in close proximity to the contact switch 20, causing the contact switch 20 to switch its output signal and the communication means to transmit an open signal as well known in the art.

Figure 2:
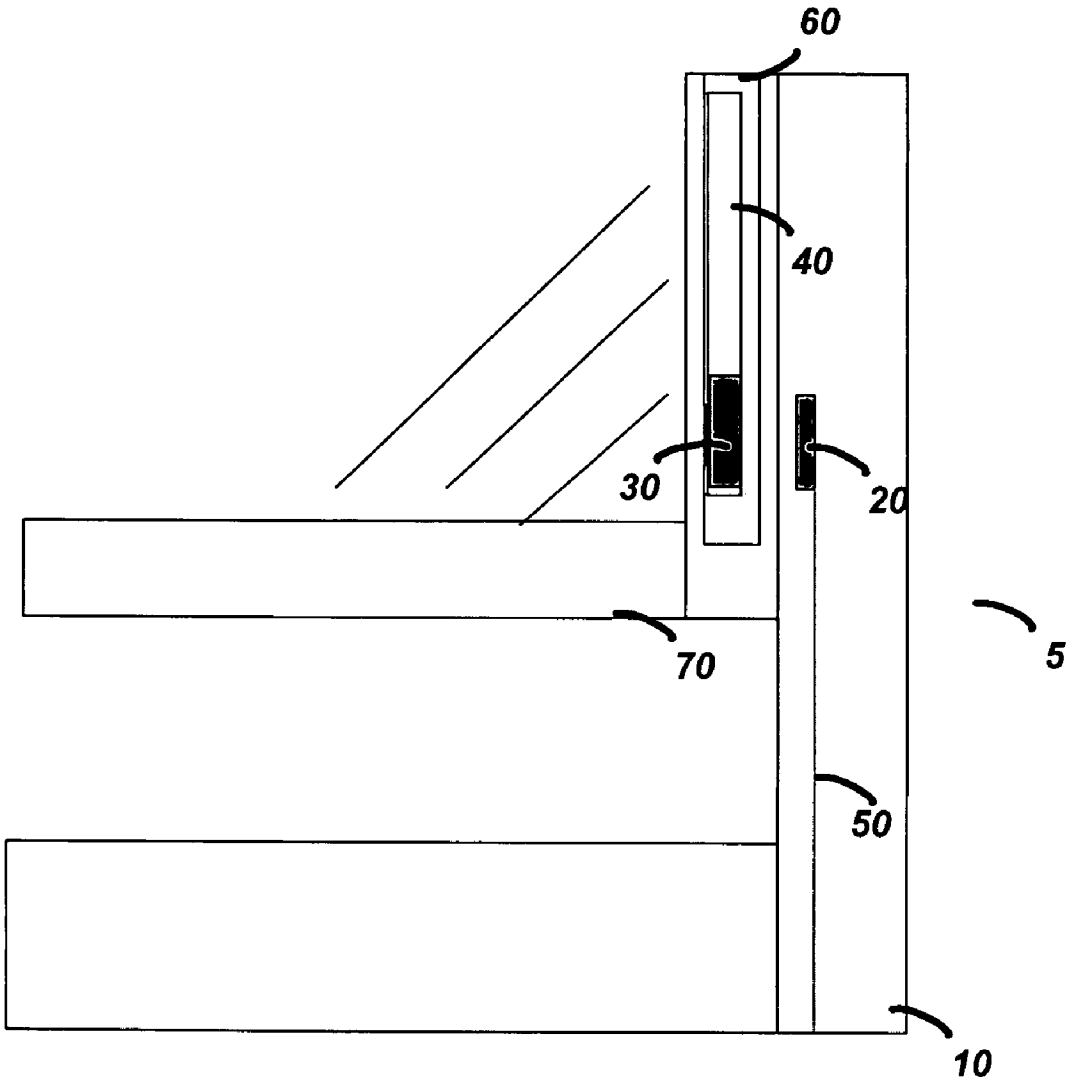
FIG. 2 is a diagram of the security device of the present invention on a vented window.

FIG. 2 is a drawing that shows the window 5 in a vented (slightly open) position. Again, the contact switch 20 is located on the window jamb 10, and the housing 60 is mounted on the window frame 70 and contains the magnet 30 and the magnet track 40. As can be seen in this figure, the window 5 is open in a vented position and the magnet 30 is located at the bottom of the track 40 at a position that is in close proximity to the contact switch 20. This will also cause the communication means to transmit a closed signal. If the window 5 is opened further, for instance to allow an intruder to enter, the magnet 30 would move upwards and not be in close proximity to the contact switch 20, causing an open signal to be generated.

Although FIG. 1 shows the magnet 30 at the top of the magnet track 40 and FIG. 2 shows the magnet 30 towards the bottom of the magnet track 40, the magnet 30 can be adjusted to any position along the magnet track 40 to allow the end user/homeowner flexibility in selecting a vented position.

Figure 3:
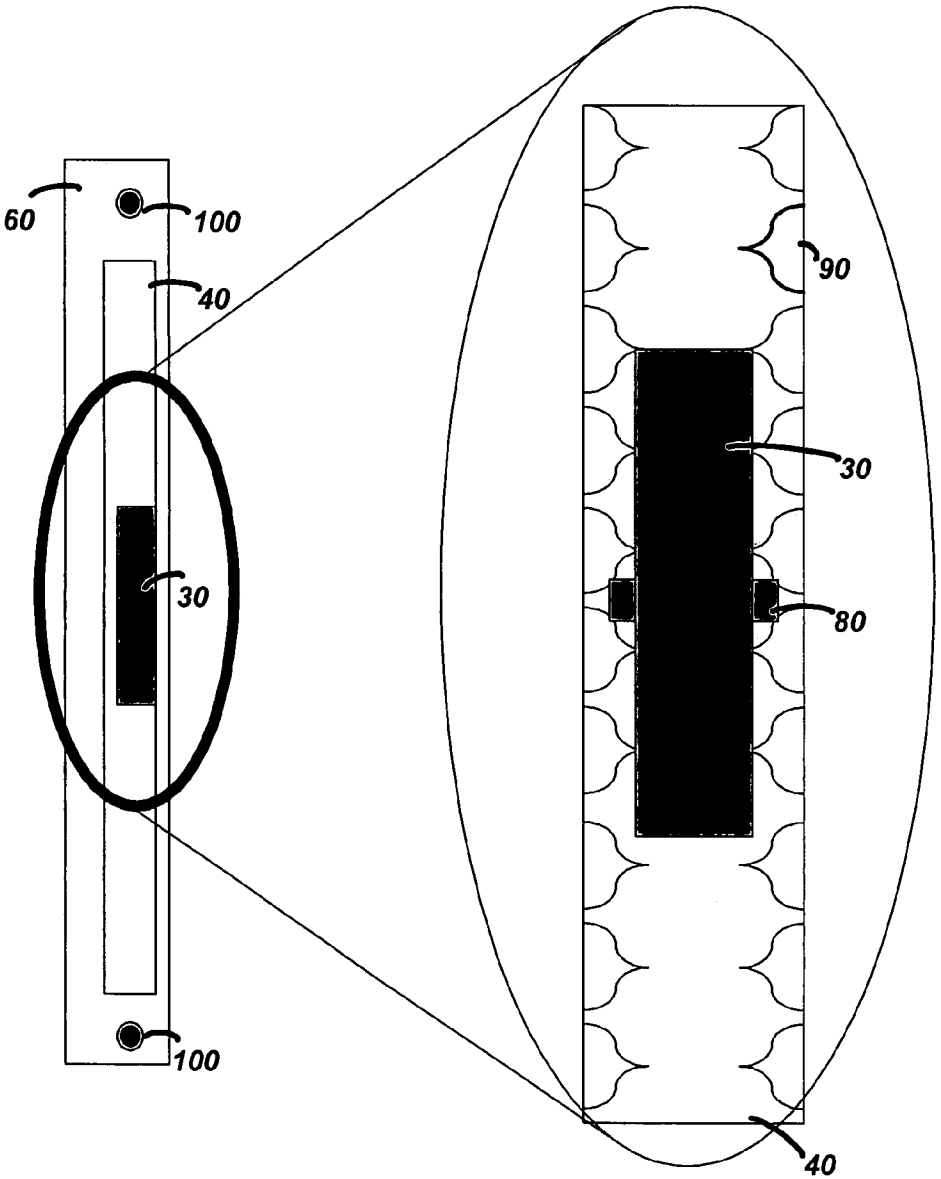
FIG. 3 is a more detailed drawing of the security device of the present invention.

FIG. 3 shows a more detailed drawing of the housing 60 with mounting holes 100, magnet track 40, and magnet 30. The magnet track 40 contains notches 90 along the length of the magnet track 40 and on both sides. The magnet 30 is held in place along the magnet track 40 by the engagement means 80 which are connected to the magnet 30 and located on either side of the magnet 30. The engagement means 80 may be plastic tabs that slide along the track 40 when pushed by an end user/homeowner and lock between the notches 90 when not pushed. Any mechanism for allowing the magnet 30 to be held in place in the track 40 and relocated by the user when desired may be used in the alternative to the preferred embodiment shown.

Figure 4:
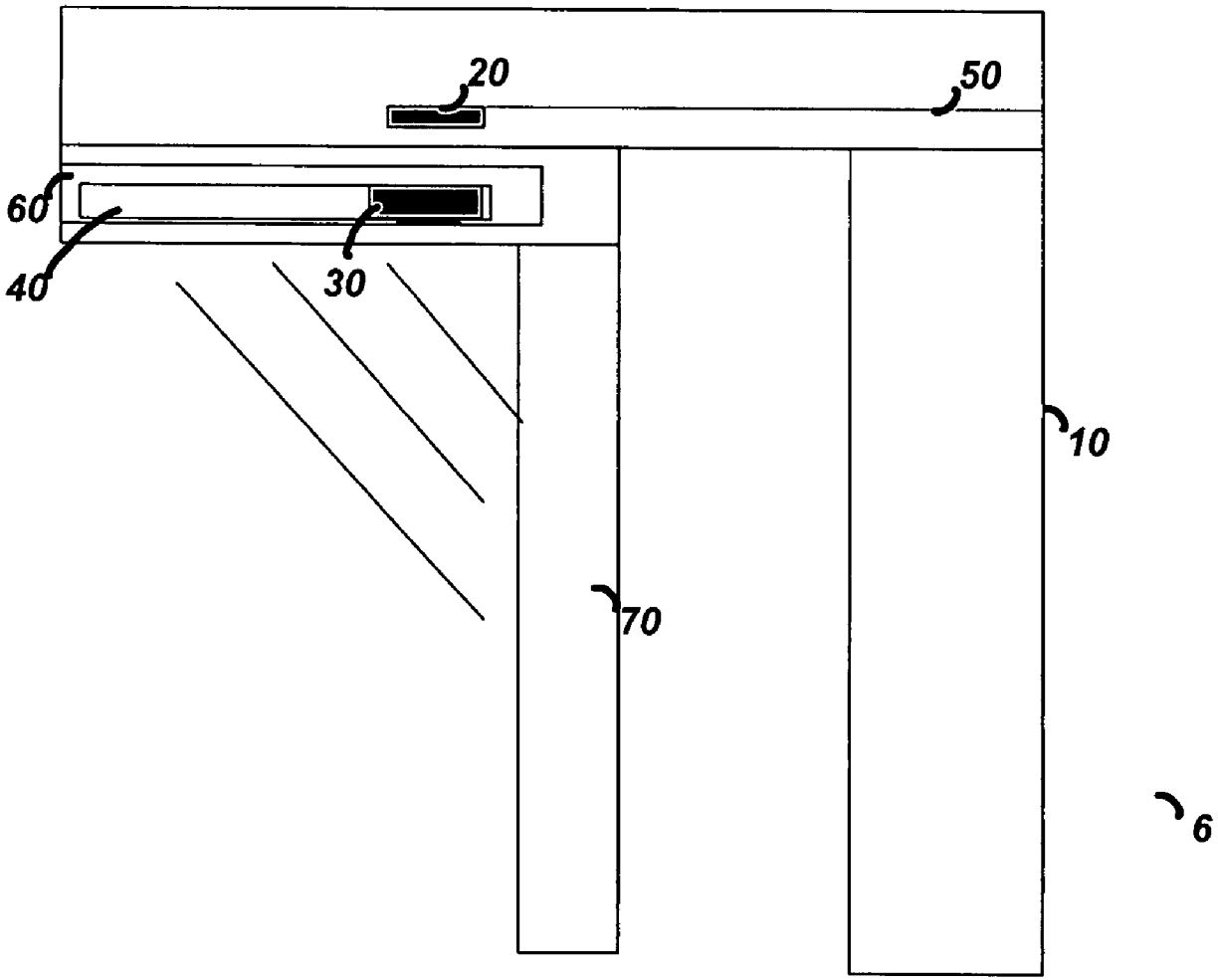
FIG. 4 is a diagram of an alternative embodiment of the present invention.

FIG. 4 shows an alternative embodiment of the present invention, where the security device of the present invention is mounted to a sliding window or door 6 rather than double hung window 5. The operation is basically the same, except that the magnet 30 slides horizontally across the track 40 rather than vertically. The housing 60 is still mounted to the window frame 70 but along the top rather than the side, and the contact switch 20 and the wire 50 are mounted to the top of the window jamb 10 rather than the side of the window jamb 10.

Figure 5:
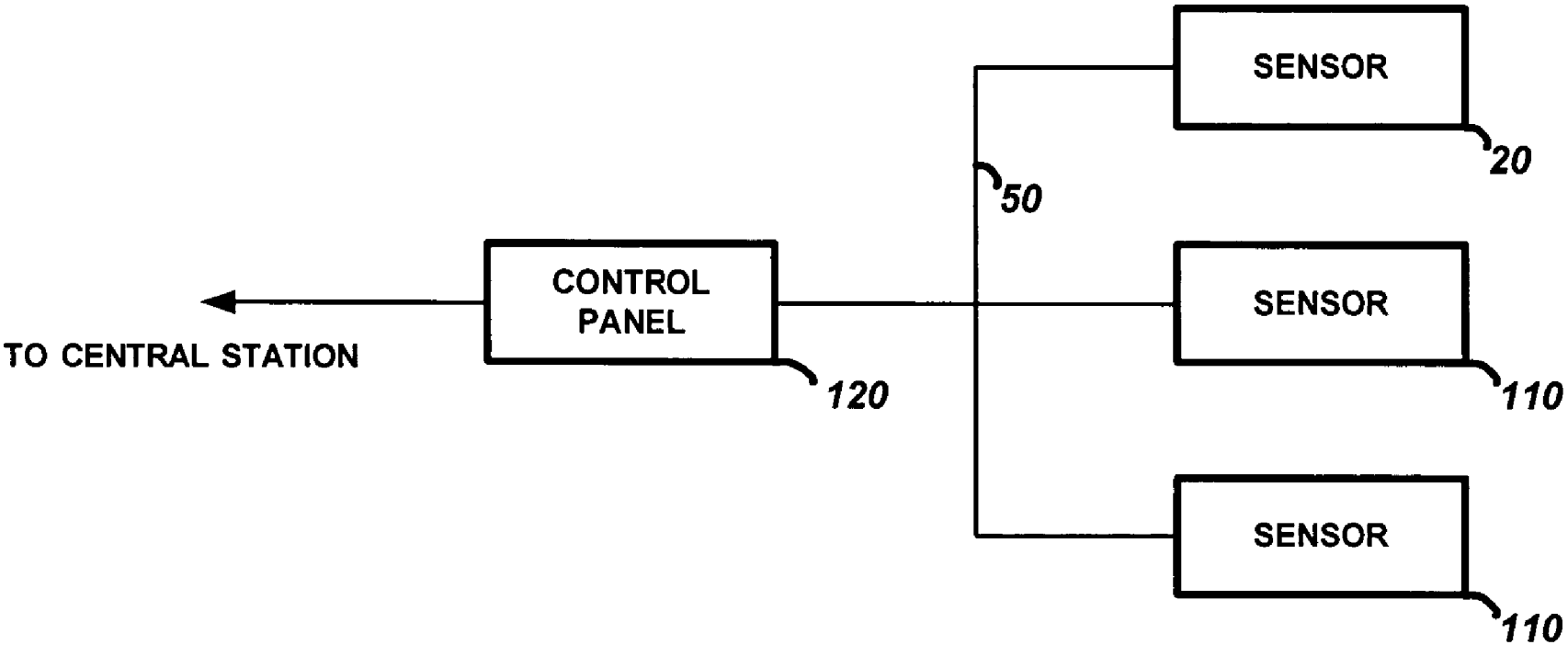
FIG. 5 is a block diagram of a security system comprising the security device of the present invention.

FIG. 5 shows a security system in communication with the contact switch 20. As well known in the art, the contact switch 20 along with multiple sensors 110 located throughout the dwelling are in communication with a control panel 120 via a wired or wireless connection. The multiple sensors 110 may be other contact switches, glass break detectors, motion detectors, or key pads, etc. The control panel 120 monitors the communications means 50 to determine if a sensor has been activated, and if the system is armed, it sends an alarm signal to a central station as well known in the art.

It will be apparent to those skilled in the art that modifications to the specific embodiment described herein may be made while still being within the spirit and scope of the present invention. For example the engagement means 80 and the notches 90 may have a different shapes or sizes. Also the mounting holes 100 may not be holes but adhesive strips. The housing of the present invention may be made of transparent plastic or another material to provide the end user/home owner with a more aesthetically pleasing option. The design of the present invention also provides the installer options for use of various reed or contact switch 20 devices.

What is claimed is:

1. A security device comprising:

a. a magnetic member having a member length, b. a housing having a length substantially longer than the member length, said housing adapted to be mounted along a window, c. means for mounting the magnetic member at a desired location along the housing and relocating the magnetic member to a different location when desired, and d. a contact switch adapted to provide a first output signal when said contact switch is in proximity to said magnetic member and a second output signal when said contact switch is not in proximity to said magnetic member.

2. The security device of claim 1 wherein the means for mounting the magnetic member comprises a track extending substantially along the length of the housing and means for slidingly engaging the magnetic member along the track, whereby the magnetic member may be engaged at a desired location on the track.

3. The security device of claim 2 wherein said means for slidingly engaging the magnetic member along the track comprises a plurality of notches located along the length of the track and notch engagement means located on the magnetic member for allowing selective engagement of the magnetic member along the track.

4. A security system comprising the security device of claim 1 wherein the housing is mounted to a first component of the window and the contact switch is mounted to a second component of the window so as to be in proximity to the magnetic member when the first component of the window and the second component of the window are in a first relative position with respect to each other and to be out of proximity to the magnetic member when the first component of the window and the second component of the window are in a second relative position with respect to each other.

5. The security system of claim 4 wherein the first relative position is the window in a closed position and the second relative position is the window in an open position.

6. The security system of claim 4 wherein the first relative position is the window in a vented position and the second relative position is the window in a fully open position.

7. The security system of claim 4 further comprising a control panel and means for communicating the first output signal and the second output signal from the contact switch to the control panel.

8. The security system of claim 4 wherein the first component of the window is the window jamb and the second component of the window is the window frame.

9. The security system of claim 4 wherein the first component of the window is the window frame and the second component of the window is the window jamb.

10. A method of adjusting a security device mounted along a window to allow for adjustable venting of said window, wherein said security device comprises a magnetic member having a member length in a housing having a length substantially longer than the member length, and a contact switch for outputting a signal dependent on the relative position of the magnetic member to the contact switch, comprising the steps of, a. locating the magnetic member in a first position in the housing such that when the window is in a first position the magnetic member is in close proximity to the contact switch causing the contact switch to output a first output signal, and when the window is in a second position the magnetic member is not in close proximity to the contact switch causing the contact switch to output a second output signal, and b. relocating the magnetic member in a second position in the housing such that when the window is in a vented position the magnetic member is in close proximity to the contact switch causing the contact switch to output the first output signal, and when the window is in a second position the magnetic member is not in close proximity to the contact switch causing the contact switch to output the second output signal.

11. The method of claim 10 wherein the window in a first position is a closed position and the window in a second position is a substantially open position.

12. The method of claim 10 wherein the first output signal is a normal condition and the second output signal is an alarm condition.

13. The method of claim 10 wherein relocating the magnetic member requires sliding the magnetic member along a track located in the housing.

* * * * *